US012253013B2

(12) United States Patent
Woelfling et al.

(10) Patent No.: US 12,253,013 B2
(45) Date of Patent: Mar. 18, 2025

(54) METHOD FOR DETERMINING AN EFFECTIVE PREVAILING UNCERTAINTY VALUE FOR AN EMISSION VALUE FOR A GIVEN TIME POINT WHEN OPERATING A DRIVETRAIN OF A MOTOR VEHICLE

(71) Applicant: Robert Bosch GmbH, Stuttgart (DE)

(72) Inventors: Jurij Woelfling, Bietigheim-Bissingen (DE); Roberto Verrino, Stuttgart (DE); Timm Hollmann, Benningen A.N. (DE); Ralf Knitz, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 107 days.

(21) Appl. No.: 18/169,924

(22) Filed: Feb. 16, 2023

(65) Prior Publication Data

US 2023/0279800 A1 Sep. 7, 2023

(30) Foreign Application Priority Data

Feb. 17, 2022 (DE) ..... 10 2022 201 661.0

(51) Int. Cl.
*F01N 11/00* (2006.01)

(52) U.S. Cl.
CPC ..... *F01N 11/00* (2013.01)

(58) Field of Classification Search
CPC ..... F01N 11/00; F01N 2550/00; F01N 2900/0408; F02D 41/1473; F02D 2250/14; F02D 41/1444; F02D 41/0235
See application file for complete search history.

(56) References Cited

U.S. PATENT DOCUMENTS

| | | | | |
|---|---|---|---|---|
| 10,808,590 | B2 * | 10/2020 | Shost | F01N 9/00 |
| 2013/0199177 | A1 * | 8/2013 | Holberg | F01N 11/00 60/276 |
| 2018/0266353 | A1 * | 9/2018 | Shirasaki | F02D 41/1441 |

FOREIGN PATENT DOCUMENTS

| | | | |
|---|---|---|---|
| DE | 102015201449 | B3 | 4/2016 |
| DE | 102020204809 | A1 | 10/2021 |

* cited by examiner

*Primary Examiner* — Brandon D Lee
(74) *Attorney, Agent, or Firm* — Michael Best & Friedrich LLP

(57) ABSTRACT

The invention relates to a method for determining an effective prevailing uncertainty value (304, 305) for an emission value (301, 302) for a given time point when operating a drivetrain (100) of a motor vehicle with an internal-combustion engine (110), wherein, at different times (n), one prevailing emission value (301) and one prevailing uncertainty value (303) are determined for the emission value, wherein the effective prevailing uncertainty value (304, 305) for the given time point is determined from prevailing uncertainty values (303) and prevailing emission values (301) prior to the given time point.

11 Claims, 3 Drawing Sheets

METHOD FOR DETERMINING AN EFFECTIVE PREVAILING UNCERTAINTY VALUE FOR AN EMISSION VALUE FOR A GIVEN TIME POINT WHEN OPERATING A DRIVETRAIN OF A MOTOR VEHICLE

BACKGROUND OF THE INVENTION

The present invention relates to a method for determining an effective prevailing uncertainty value for an emission value for a given time point when operating a drivetrain of a motor vehicle with an internal-combustion engine, as well as to a computing unit and a computer program for executing said method.

A constant tightening of threshold values for pollutant emissions, in particular of motor vehicles, places high demands on modern engines. Particulate and nitrogen oxide emissions are under particular scrutiny. At the same time, it is usually required, both by authorities and by customers, to progressively reduce fuel consumption and also carbon dioxide emissions, because carbon dioxide emissions are a major cause of global warming.

Target values for corresponding control values or actuators of engine and exhaust gas aftertreatment systems can be stored in two-dimensional program maps, for example, as a function of the load and speed of the internal-combustion engine, and read online.

If applicable, these target values can then be corrected as a function of prevailing ambient conditions and/or system conditions (such as engine temperature, catalyst temperature, and the like). Correction functions for reducing emissions in a transient operation of the internal-combustion engine can also be used.

SUMMARY OF THE INVENTION

According to the present invention, a method for determining an effective prevailing uncertainty value for an emission value for a given time point when operating a drivetrain of a motor vehicle, as well as a computing unit and a computer program for its implementation are proposed.

When operating an internal-combustion engine, situations can occur where prevailing values for ambient conditions or system conditions cannot be measured but rather must be modeled. At the beginning of the drive cycle, for example, it is often not possible to determine an emission value using a sensor, due to necessary heating phases. However, the models that are used instead are much less accurate. Generally, however, both measured and modeled values can deviate from the actual emission value. Such deviations are hereinafter referred to as the "uncertainty" or "tolerance". For example, it can be a measurement inaccuracy of a sensor or a modeling inaccuracy of a model.

A method according to the present invention is used in order to more precisely determine a prevailing uncertainty value and to use it in the operation of an internal-combustion engine. In particular, the effective prevailing uncertainty value for the given time point can be used in case of actuation of the drivetrain and/or when evaluating the prevailing emission value or emission levels.

Its usage in actuation leads in particular to the reduction of emissions, i.e. pollutants, in particular so-called tailpipe emissions, during operation of a motor vehicle. This includes not only vehicles with an internal-combustion engine as the only drive source, but in particular also so-called hybrid vehicles having an internal-combustion engine and one or more electric machines for the drive. As long as an internal-combustion engine is operated at least intermittently, a reduction in emissions is desirable. In particular, the drivetrain of the motor vehicle comprises an exhaust gas system and an exhaust gas aftertreatment system in addition to the internal-combustion engine. Nitrogen oxide (NOx), carbon dioxide ($CO_2$), carbon monoxide (CO), hydrocarbon (HC), ammonia ($NH_3$), or particulates or their number or mass, in particular fine dust, are considered as the emission component.

The present invention allows the use of an emissions-based regulation with more precise tolerance levels in the emission determination of the individual emission components during the respective travel cycle. On the other hand, the validity of measured or modeled emission levels can be evaluated with more precise emission uncertainties. This can be relevant for both OBM (on-board monitoring) and other diagnoses.

Specifically, for this purpose, an effective prevailing uncertainty value is determined for an emission value for a given time point when operating a drivetrain of a motor vehicle with an internal-combustion engine, wherein, at different times, one prevailing emission value and one prevailing uncertainty value are determined for the emission value, wherein the effective prevailing uncertainty value for the given time point is determined from prevailing uncertainty values and prevailing emission values prior to the given time point. In particular, this can be done by way of an emission value-based weighting (i.e. the effective prevailing uncertainty value for the given time point is determined from prevailing uncertainty values weighted with the respective prevailing emission value prior to the given time point), so that the influence of the individual prevailing uncertainty values on the effective prevailing uncertainty value is represented in greater detail. The time point before or up to the given time point taken for the calculation can preferably be selected by the person skilled in the art depending on the application. In any case, it is expedient to proceed as soon as possible before the specific time point. The shorter the period, the more the result corresponds to the prevailing value; the longer the period, the more the result corresponds to a temporal "smoothing" or "integration." For example, the effective prevailing uncertainty value for the given time point can be determined according to a sliding or weighted average or exponential smoothing.

Preferably, a prevailing actual value of an emission component is determined as the prevailing emission value, in particular measured by means of a corresponding sensor or determined ("modeled") by means of a corresponding computational model, wherein the actual value of the emission component is regulated up to a target value by the output of at least one control value to the drivetrain when the actual value is within a regulation range above a minimum value range and below a maximum value range. A height of the minimum value range and/or the maximum value range is specified in a tolerance-dependent manner, i.e. depending on the effective prevailing uncertainty value.

Preferably, the maximum value range is limited upwards by a maximum value or upper limit value, which is reasonably defined by statutory provisions. Below the maximum value is the maximum value range, which corresponds to the effective prevailing uncertainty value. Preferably, the minimum value range is limited downward by a minimum value or lower limit value, which is reasonably defined by engine requirements (e.g. in order to ensure stable combustion or the like). Above the minimum value is the minimum value range, which also corresponds to the effective prevailing uncertainty value. In this way, the effective prevailing uncertainty value can be used particularly effectively for drivetrain control.

In particular, a maximum control value is output to the drivetrain when the actual value is at least within the maximum value range, and a minimum control value (can also be zero, i.e. "regulation off") is output to the drivetrain when the actual value is at most within the minimum value range. Thus, the respective emission level can preferably be kept within the regulation range.

The possibility of regulation (or "of the regulator") to comply with this regulation range is hereinafter referred to as "target-directed regulation". Above the regulation range, the regulation maximally intervenes, but will not always prevent a temporary emission overrun, rather it can only shorten it. Below the regulation range, the regulator intervenes minimally or is completely deactivated in order to avoid deterioration of driveability and consumption.

In particular, the time dependence of the effective prevailing uncertainty value causes the size and height of the regulation range to change over time. In extreme cases, with great uncertainties, the regulation range can disappear completely, so that targeted regulation is not possible. The advantage of using a time-based regulation range is that if there is high uncertainty, non-targeted interventions of the emissions-based regulation in the minimum value range are avoided, and thus no deterioration of driveability and consumption occurs.

In order to reduce emissions or tailpipe emissions, there are different actions and procedures that can be achieved by a corresponding definition of associated control values. The raw emissions of the internal-combustion engine (i.e. the internal-combustion engine raw emissions) can be reduced by, for example, changing at least one combustion parameter (e.g. injection duration, injection amount, number and timing of injections, ignition time point(s), air quantity). The catalyst efficiency can be increased, e.g. by heating up the exhaust gas system and/or varying the NSC regeneration strategy. An operating point displacement of the internal-combusting engine, if applicable in combination with an electric machine, can be carried out, e.g. by adding and removing load within the framework of a hybrid operating strategy, up to purely electric driving or by switching on additional consumers. A selection of a gear of the transmission can be changed. Likewise, two or more of these methods can be combined or used. The associated control values (or actuators) in particular comprise a rotation speed, an injection characteristic and/or injection targets, or an operating mode of the exhaust gas aftertreatment system (incl. catalysts), and the like.

A computing unit according to the invention, e.g. a control unit of a motor vehicle, is configured, in particular in terms of program technology, so as to carry out a method according to the invention.

The implementation of a method according to the invention in the form of a computer program or computer program product with program code for carrying out all method steps is also advantageous since this results in particularly low costs, in particular if an executing control unit is also used for further tasks and is therefore already present. Finally, a machine-readable storage medium is provided, with a computer program stored thereon as described above. Suitable storage media or data carriers for providing the computer program are in particular magnetic, optical and electrical memories such as hard disks, flash memory, EEPROMs, DVDs, etc. Downloading a program via computer networks (Internet, Intranet, etc.) is possible as well. Such a download can be wired or cabled or wireless (e.g. via a WLAN, a 3G, 4G, 5G or 6G connection, etc.).

Further advantages and configurations of the invention become apparent from the description and the accompanying drawing.

BRIEF DESCRIPTION OF THE DRAWINGS

The invention is illustrated schematically in the drawing on the basis of embodiment examples and is described in detail in the following with reference to the drawing.

DETAILED DESCRIPTION

Figure 1:
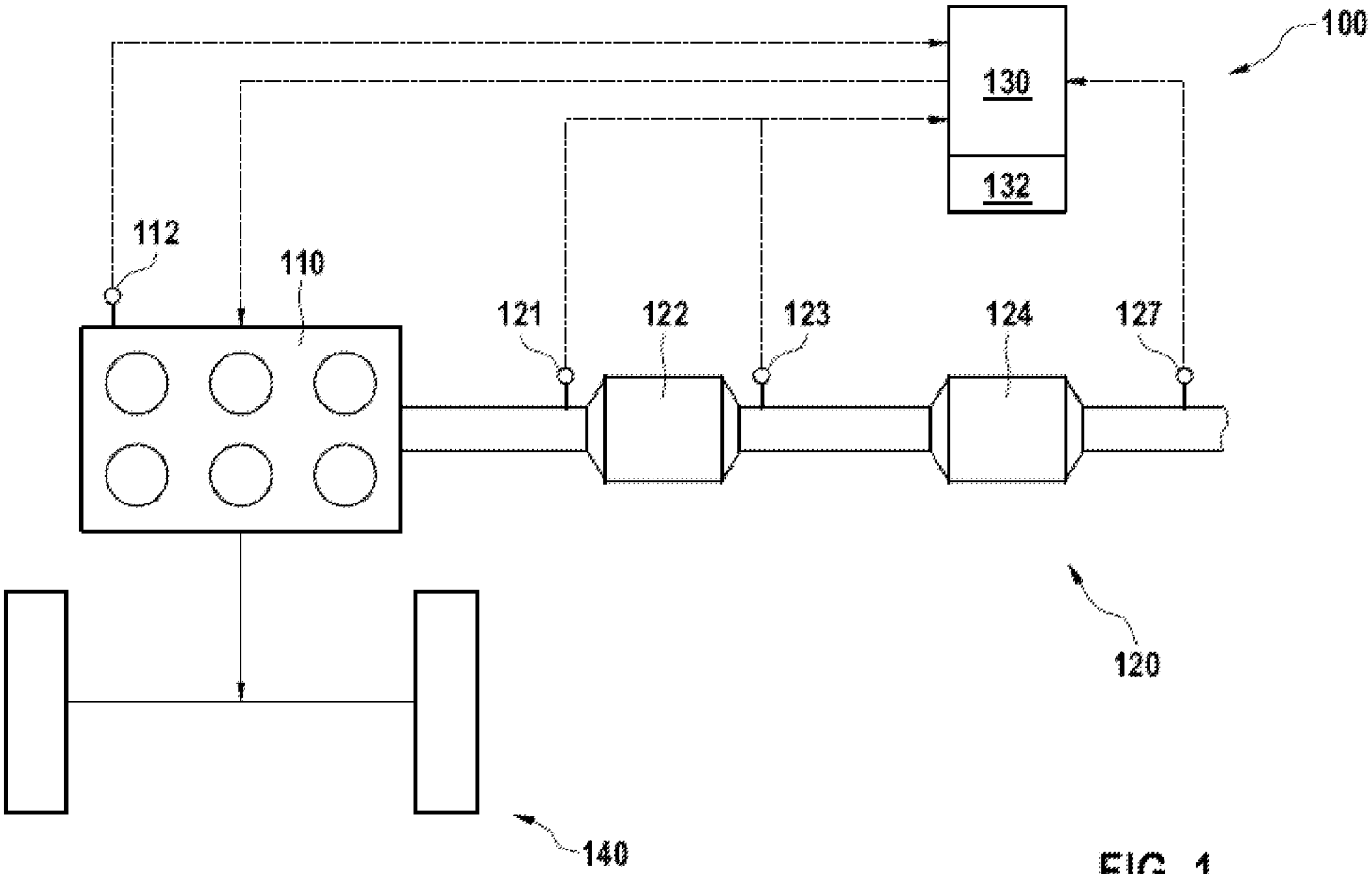
FIG. 1 schematically shows a vehicle having an internal-combustion engine and a catalyst, as can be used in the context of the present invention.

In FIG. 1, a drivetrain of a vehicle, as can be used in the context of the invention, is shown schematically and bears the overall reference number 100. The drivetrain 100 comprises an internal-combustion engine 110, for example having six indicated cylinders, an exhaust gas system 120 having multiple cleaning components 122, 124, such as catalysts and/or particulate filters, and a computing unit 130 configured so as to control the internal-combustion engine 110 and exhaust gas system 120 and connected to them in a data-conducting manner. Further, in the illustrated example, the computing unit 130 is connected to sensors 112, 121, 123, 127 in a data-conducting manner, which record operating parameters of the internal-combustion engine 110 and/or the exhaust gas system 120. It is understood that there can be other sensors that are not shown.

In the example shown here, the computing unit 130 comprises a data memory 132 in which, for example, computational instructions and/or parameters (e.g. threshold values, characteristics of the internal-combustion engine 110 and/or the exhaust gas system 120, or the like) can be stored.

The internal-combustion engine 110 drives wheels 140 and can also be driven by the wheels in certain operating phases (e.g. so-called coasting mode)

Figure 2:
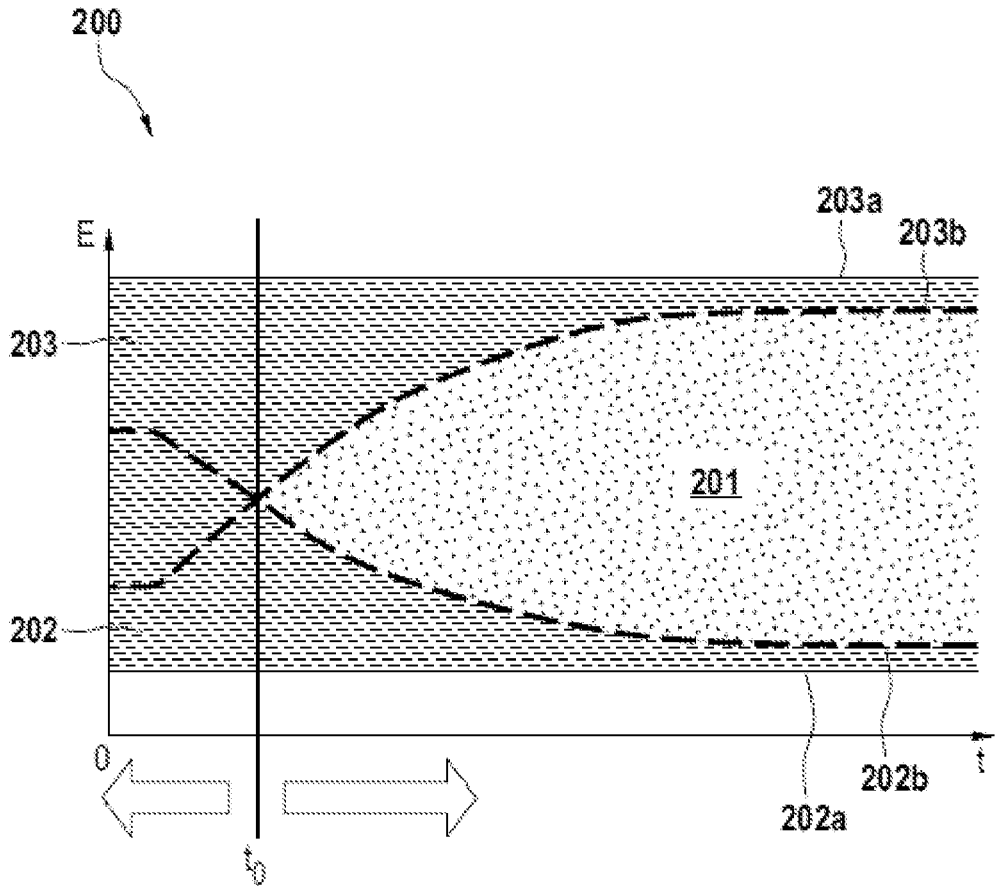
FIG. 2 shows a regulation range for an emission component as a function of time, as can arise in the context of a preferred embodiment of the invention.

In FIG. 2, a regulation range for an emission component as a function of time is shown, as can arise in the context of a preferred embodiment of the invention. In a diagram 200, the regulation behavior for different actual values E of an emission component is plotted against time t. A regulation range as it arises in the context of the invention bears the reference number 201. The regulation range 201 defines the range in which a respective prevailing actual value of the emission component E is to be located at a respective time point and is limited downward by a minimum value range 202 and upward by a maximum value range 203.

The minimum value range 202 in turn is limited downward by a minimum value 202*a* and upward by a minimum tolerance value 202*b* corresponding to a sum of a prevailing tolerance and the minimum value 202*a*. Likewise, the maximum value range 203 is limited upward by a maximum value 203*a* and downward by a maximum tolerance value 203*b*, the difference between which also corresponds to the prevailing tolerance.

Expediently, the minimum value 202*a* is determined by engine conditions in order to ensure combustion, and the maximum value 203*a* is determined by statutory provisions in order to avoid high emissions.

For example, the upper tolerance value 203*b*, $\text{Limit}_{upper}$, can be calculated from the maximum value 203*a*, Emission $\text{limit}_{upper}$, and the time-based tolerance $\text{Tol}_{eff}$ according to the following equation:

$$\text{Limit}_{upper} = \frac{\text{emission limit}_{upper}}{(1 + Tol_{eff})}$$

For example, the lower tolerance value 202*b*, $\text{Limit}_{lower}$, can be calculated from the minimum value 202*a*, Emission limit and the time-based tolerance $\text{Tol}_{eff}$ according to the following equation:

$$\text{Limit}_{lower} = \text{emission limit}_{lower} \cdot (1 + \text{TOl}_{eff})$$

Beyond the limits, either compliance with the statutory limit values is no longer guaranteed, or there is an unnecessarily frequent intervention of the emissions-based regulator, leading to a deterioration of driveability and consumption, or even both at the same time.

It can be seen that, at the start of operation between a time point t=0 and a time point $t=t_0$, the minimum value range 202 and maximum value range 203 together (or the tolerance $\text{Tol}_{eff}$) are so great that no regulation range exists. From the time point $t=t_0$, at which the lower tolerance value 202*b* and the upper tolerance value 203*b* intersect, the regulation range 201 is present, which then grows with time and continues increasing. The tolerance $\text{Tol}_{Sp}$ at the intersection $t=t_0$ is calculated accordingly according to the following equation:

$$\frac{\text{emission limit}_{upper}}{(1 + Tol_{Sp})} = \text{emission limit}_{lower} \cdot (1 + Tol_{Sp})$$

$$\frac{\text{emission limit}_{upper}}{\text{emission limit}_{lower}} = (1 + Tol_{Sp})^2$$

$$Tol_{Sp} = \sqrt{\frac{\text{emission limit}_{upper}}{\text{emission limit}_{lower}} - 1}$$

The time-dependent calculation of the tolerance is based on the finding that tolerance or uncertainty of the emission determination is different at various time points in the travel cycle. This is especially true when the emissions are determined via a low tolerance sensor (which substantially corresponds to a measurement in accuracy), which is however not ready at the start of the journey. It can therefore be provided that the emission value is determined on the basis of a model for this initial phase immediately after starting the internal-combustion engine (t>0) and that a model tolerance is assumed that is usually significantly above a sensor tolerance.

How strongly a single tolerance Tol(i) (i.e. tolerance or tolerance range at step or time point "i") influences the overall tolerance $\text{Tol}_{overall}$, depends on how high the generated emission mass is within the individual tolerances in relation to the total mass. The overall tolerance $\text{Tol}_{overall}$ on the other hand, results from the following equation:

$$Tol_{overall} = \frac{\sum_{i=k}^{i=k} mEmi_i \cdot Tol_i}{mEmi_{overall}} \tag{1}$$

Here, mEmi(i) stands for the emission mass that was generated at the time i. The index k corresponds to the number of different tolerance ranges and, in the borderline case, the number of measurement points.

By weighting the single tolerance with the emission amount, the effect on the overall tolerance is correctly represented. A high tolerance at low mass emission flow has a significantly lower effect on the overall tolerance than in the case of a high mass flow. Therefore, the calculation is discretized over the travel path.

To assess the effective tolerance $\text{Tol}_{ExpSmotng}(t)$ at a time point t (within a shorter interval than the overall travel distance), the effective tolerance is calculated based on an exponential smoothing:

$$Tol\,\text{Exp}\,Smotng(t) = \frac{\alpha \cdot mEmi(t) \cdot Tol(t) + \sum_{i=1}^{t-1}\left[(1-\alpha)^i \cdot (mEmi(t-i) \cdot Tol(t-i))\right]}{\alpha \cdot mEmi(t) + \sum_{i=1}^{t-1}\left[(1-\alpha)^i \cdot mEmi(t-i)\right]} \tag{2}$$

Here, a stands for the smoothing factor or present factor and i indicates how far in the past the respective time step is. This calculation allows for a lower weighting of emissions and tolerances that are further in the past, and thus the response is better to changes in the prevailing tolerance level than if all measurement points were only weighted in a mass-dependent manner, as in equation (1). However, other methods of smoothing, such as a sliding or weighted average, can also be used.

The calculation shown in equation (2) corresponds to an exponential smoothing. In so doing, the distance section emissions mEmi are multiplied by the average tolerance Tol for this path section and then integrated/summed. The respective tolerances result from the tolerance of the sensor (usually dependent on the concentration of the emission: the lower the concentration, the higher the tolerance) or from the error of the emission model used (usually dependent on the operating point, e.g. less precise in the cold engine than in the warm engine).

The individual parameters mEmi and Tol for the distance section i are calculated continuously. The further these lie in the past, the less influence they have on the prevailing tolerance after distance section t.

The smoothing serves to properly evaluate the tolerance of the prevailing (and likewise smoothed) emissions:

Overall emissions require an overall tolerance

Smoothed emissions require a smoothed tolerance

Figure 3A:
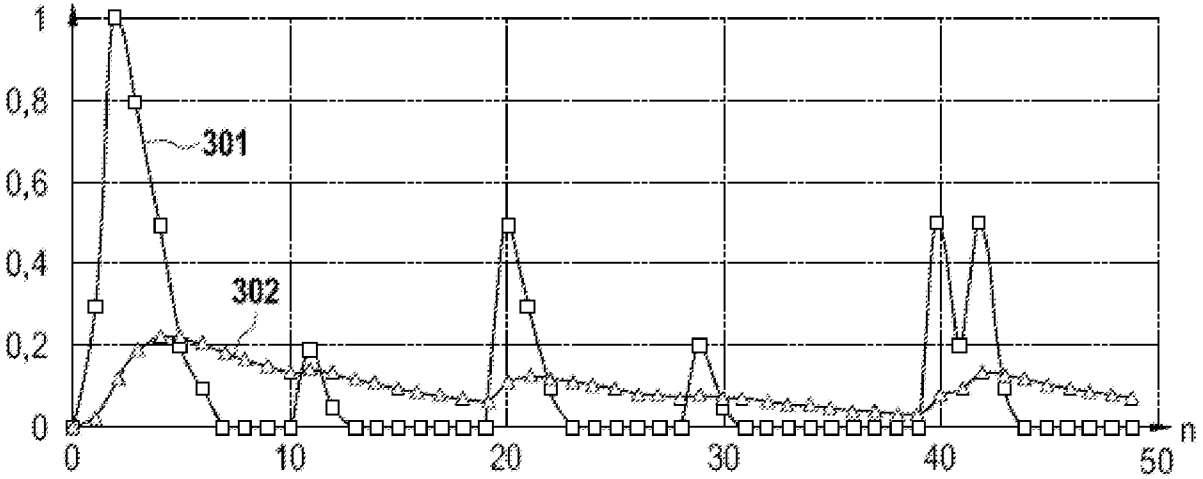
FIG. 3A-3B show an exemplary progression of an emission component and tolerance and derived values, as can arise in the context of a preferred embodiment of the invention.

In FIG. 3*a*, an exemplary progression of an emission value in any desired units is plotted against a number n of measurement points and bears the reference number 301. An exponentially smoothed progression bears the reference number 302.

Figure 3B:
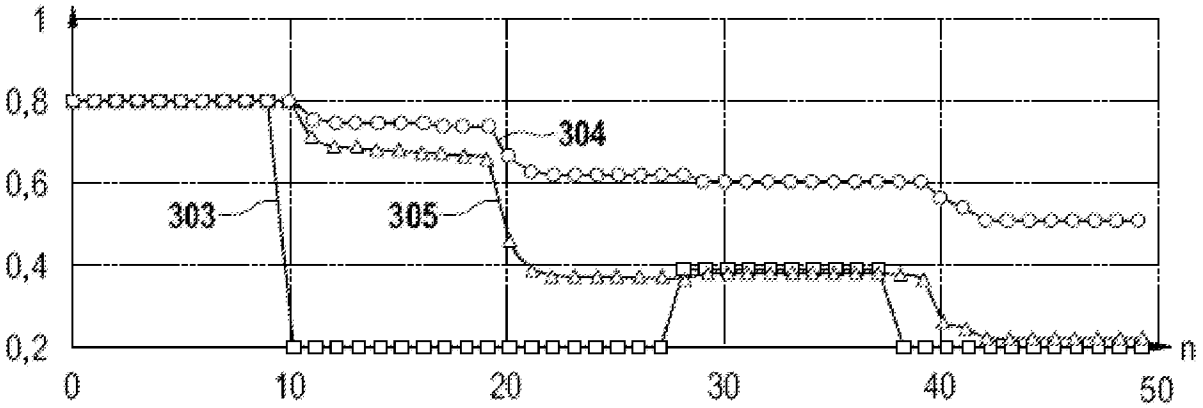

In FIG. 3*b*, a respective prevailing tolerance bears the reference number 303, an effective overall tolerance for the entire travel path according to equation 1 bears the reference number 304, and an effective tolerance based on exponential smoothing according to equation 2 bears the reference number 305.

The prevailing tolerance is known for a sensor, e.g. from its technical data (e.g. 10% deviation for a measured value>100 ppm) and for a model from its verification during the model creation (e.g. it is possible for a model to have a higher tolerance in a cold engine than in a warm one).

Based on the tolerances in FIG. 3*b*, the intervention limits in FIG. 2 can then be calculated, or diagnoses can be evaluated in the concrete case of application.

The invention claimed is:

1. A method for determining an effective prevailing uncertainty value (304, 305) for an emission value (301, 302) for a given time point when operating a drivetrain (100) of a motor vehicle with an internal-combustion engine (110), the method comprising:

determining, for the emission value (301,302) at an initial phase ($0<t<t_0$) immediately after starting the internal-combustion engine ($t>0$), prevailing emission values (301) and prevailing uncertainty values (303), wherein the prevailing uncertainty values (303) are tolerances of a computational model (130, 132) determining the prevailing emission values (301), determining, for the emission value (301,302) at different times (n) following the initial phase, prevailing emission values (301) and prevailing uncertainty values (303), wherein the prevailing uncertainty values (303) are respective tolerances of a sensor (112, 121, 123, 127) or the computational model (130, 132) determining the prevailing emission values (301), determining the effective prevailing uncertainty value (304, 305) for the given time point based on the prevailing uncertainty values (303) and the prevailing emission values (301) prior to the given time point, controlling operation of the drivetrain (100) by outputting a control value to the drive train (100) based on the effective prevailing uncertainty value (304, 305).

2. The method according to claim 1, wherein the effective prevailing uncertainty value (304, 305) for the given time point is determined based on the prevailing uncertainty values (303) weighted with the respective prevailing emission values (301) before the given time point.

3. The method according to claim 1, wherein the effective prevailing uncertainty value (304, 305) for the given time point is determined based on at least one selected from a group consisting of: a sliding average, a weighted average, and exponential smoothing.

4. The method according to claim 1, wherein the effective prevailing uncertainty value (304, 305) is used for the given time point upon an actuation of the drivetrain (100) and/or upon an evaluation of the prevailing emission value.

5. The method according to claim 4, the method further comprising:

wherein a prevailing actual value of an emission component is the prevailing emission value (301), determining a regulation range (201) of the emission component, wherein the regulation range (201) includes a minimum value range (202) and a maximum value range (203), wherein the maximum value range (203) is an upper limit and based on a maximum value (203*a*), wherein the minimum value range (202) is determined is a lower limit and based on a minimum value (202*a*), and regulating an actual value of the emission component to a target value by outputting the control value to the drivetrain (100) when an actual value of the emission component is in the regulation range (201) above the minimum value range (202) and below the maximum value range (202), wherein the effective prevailing uncertainty value (304, 305) is below the maximum value range, and/or wherein the effective prevailing uncertainty value (304, 305) is above minimum value range (202).

6. The method according to claim 5, the method further comprising:

outputting a maximum control value to the drivetrain (100) when the actual value is at least in the maximum value range (203), and/or outputting a minimum control value to the drivetrain (100) when the actual value is at most within the minimum value range (202).

7. The method according to claim 1, wherein the drivetrain (100) comprises an internal-combustion engine (110) and an associated exhaust gas system (120), wherein the actual value of the emission component is determined in the exhaust gas system (120).

8. The method according to claim 1, wherein the prevailing emission value is determined by at least one selected from a group consisting of: the sensor (112, 121, 123, 127) and the computational model (130, 132).

9. A computing unit for determining an effective prevailing uncertainty value (304, 305) for an emission value (301, 302) for a given time point when operating a drivetrain (100) of a motor vehicle with an internal-combustion engine (110), the computing unit configured to:

determine, for the emission value (301,302) at an initial phase ($0<t<t_0$) immediately after starting the internal-combustion engine ($t>0$), prevailing emission values (301) and prevailing uncertainty values (303), wherein the prevailing uncertainty values (303) are tolerances of a computational model (130, 132) determining the prevailing emission values (301), determine, for the emission value at different times (n) following the initial phase, prevailing emission values (301) and prevailing uncertainty values (303), wherein the prevailing uncertainty values (303) are respective tolerances of a sensor (112, 121, 123, 127) or the computational model (130, 132) determining the prevailing emission values (301), determine the effective prevailing uncertainty value (304, 305) for the given time point based on the prevailing uncertainty values (303) and the prevailing emission values (301) prior to the given time point, and control operation of the drivetrain (100) by outputting a control value to the drive train (100) based on the effective prevailing uncertainty value (304, 305).

10. The method according to claim 1, wherein the respective tolerances relate to an accuracy of the sensor (112, 121, 123, 127) or the computational model (130, 132) when determining the prevailing emission values (301).

11. A non-transitory computer-readable medium for determining an effective prevailing uncertainty value (304, 305) for an emission value (301, 302) for a given time point when operating a drivetrain (100) of a motor vehicle with an internal-combustion engine (110), the non-transitory computer-readable medium including instructions executable by an electronic processor to perform a set of functions, the set of functions comprising:

determine, for the emission value (301,302) at an initial phase ($0<t<t_0$) immediately after starting the internal-combustion engine ($t>0$), prevailing emission values (301) and prevailing uncertainty values (303), wherein the prevailing uncertainty values (303) are tolerances of a computational model (130, 132) determining the prevailing emission values (301), determining, for the emission value at different times (n) following the initial phase, prevailing emission values (301) and prevailing uncertainty values (303), wherein the prevailing uncertainty values (303) are respective tolerances of a sensor (112, 121, 123, 127) or the computational model (130, 132) determining the prevailing emission values (301), determining the effective prevailing uncertainty value (304, 305) for the given time point based on the prevailing uncertainty values (303) and the prevailing emission values (301) prior to the given time point, and controlling operation of the drivetrain (100) by outputting a control value to the drive train (100) based on the effective prevailing uncertainty value (304, 305).

* * * * *